US010290951B2

(12) United States Patent
Jain et al.

(10) Patent No.: US 10,290,951 B2
(45) Date of Patent: May 14, 2019

(54) HYBRID LAMINATED PHASED ARRAY

(71) Applicant: Anokiwave, Inc., San Diego, CA (US)

(72) Inventors: Vipul Jain, Irvine, CA (US); Nitin Jain, San Diego, CA (US); David W. Corman, Gilbert, AZ (US)

(73) Assignee: ANOKIWAVE, INC., San Diego, CA (US)

( * ) Notice: Subject to any disclaimer, the term of this patent is extended or adjusted under 35 U.S.C. 154(b) by 0 days.

(21) Appl. No.: 15/669,339

(22) Filed: Aug. 4, 2017

(65) Prior Publication Data

US 2018/0054005 A1 Feb. 22, 2018

Related U.S. Application Data

(60) Provisional application No. 62/376,442, filed on Aug. 18, 2016.

(51) Int. Cl.

| | |
|---|---|
| ***H01Q 1/38*** | (2006.01) |
| ***H01Q 21/06*** | (2006.01) |
| ***H01Q 5/30*** | (2015.01) |
| ***H01Q 1/28*** | (2006.01) |
| ***H01Q 3/26*** | (2006.01) |
| ***H01Q 21/00*** | (2006.01) |

(Continued)

(52) U.S. Cl.

CPC ..... *H01Q 21/065* (2013.01); *H01Q 1/288* (2013.01); *H01Q 3/26* (2013.01); *H01Q 5/30* (2015.01); *H01Q 21/0087* (2013.01); *H01Q 23/00* (2013.01); *H01Q 1/42* (2013.01)

(58) Field of Classification Search

CPC .. H01Q 3/24; H01Q 5/30; H01Q 3/26; H01Q 21/065; H01Q 21/65; H01Q 23/00

USPC ..... 343/700 MS

See application file for complete search history.

(56) References Cited

U.S. PATENT DOCUMENTS 5,448,250 A 9/1995 Day
5,724,666 A 3/1998 Dent (Continued)

FOREIGN PATENT DOCUMENTS

WO WO 2017/078851 A2 5/2017

OTHER PUBLICATIONS

International Searching Authority, International Search Report—International Application No. PCT/US2017/045512, dated Nov. 16, 2017, together with the Written Opinion of the International Searching Authority, 12 pages.

(Continued)

*Primary Examiner* — Peguy Jean Pierre

(74) *Attorney, Agent, or Firm* — Nutter McClennen & Fish LLP

(57) ABSTRACT

A laminar phased array has a plurality of receive elements and dual transmit/receive elements supported on a substrate. The plurality of receive elements and dual transmit/receive elements form a patch array across the substrate. As such, the receive elements and dual transmit/receive elements form an array of patch antennas on the substrate. The phased array also has a plurality of integrated circuits supported on the substrate. At least a first set of the plurality of integrated circuits is configured to control receipt of signals by the receive elements. In a corresponding manner, at least a second set of the plurality of integrated circuits is configured to control receipt and transmission of signals by the dual transmit/receive elements.

24 Claims, 5 Drawing Sheets

(51) Int. Cl.
*H01Q 23/00* (2006.01)
*H01Q 1/42* (2006.01)

(56) References Cited

U.S. PATENT DOCUMENTS

| | | | | |
|---|---|---|---|---|
| 7,079,869 | B2 * | 7/2006 | Aytur | H01Q 21/00 455/562.1 |
| 7,087,993 | B2 | 8/2006 | Lee | |
| 7,129,568 | B2 | 10/2006 | Lee et al. | |
| 8,558,398 | B1 | 10/2013 | Seetharam | |
| 8,866,283 | B2 | 10/2014 | Chen et al. | |
| 9,750,079 | B1 | 8/2017 | Mitchell | |
| 2002/0070898 | A1 | 6/2002 | Vail et al. | |
| 2005/0017352 | A1 | 1/2005 | Lee | |
| 2005/0082645 | A1 | 4/2005 | Lee et al. | |
| 2005/0098860 | A1 | 5/2005 | Lai et al. | |
| 2006/0006505 | A1 | 1/2006 | Chiang et al. | |
| 2009/0009404 | A1 * | 1/2009 | Buer | H01Q 3/2658 343/700 MS |
| 2009/0256752 | A1 | 10/2009 | Akkermans et al. | |
| 2011/0198742 | A1 | 8/2011 | Danno et al. | |
| 2011/0242863 | A1 | 10/2011 | Park et al. | |
| 2012/0044117 | A1 | 2/2012 | Matsukuma et al. | |
| 2012/0313219 | A1 | 12/2012 | Chen et al. | |
| 2013/0050055 | A1 | 2/2013 | Paradiso et al. | |
| 2013/0187830 | A1 | 7/2013 | Warnick et al. | |
| 2014/0348035 | A1 | 11/2014 | Corman et al. | |
| 2015/0180116 | A1 | 6/2015 | Sato et al. | |
| 2016/0149302 | A1 * | 5/2016 | Sanderovich | H01Q 3/24 343/703 |
| 2016/0226155 | A1 * | 8/2016 | Warnick | H01Q 21/065 |
| 2016/0248157 | A1 | 8/2016 | Rao et al. | |
| 2017/0085006 | A1 | 3/2017 | Corman et al. | |
| 2017/0237180 | A1 | 8/2017 | Corman et al. | |

OTHER PUBLICATIONS

Bailey, *General Layout Guidelines for RF and Mixed-Signal PCBs*, Maxim Integrated, Tutorial 5100, 10 pages, Sep. 14, 2011.

Ismail, *Introduction to RF CMOS IC Design for Wireless Applications*, Analog VLSI Lab, The Ohio State University, 117 pages, undated.

Jain, *Layout Review Techniques for Low Power RF Designs*, Application Note AN098, Texas Instruments, 15 pages, 2012.

Maxim, *5GHz, 4-Channel MIMO Transmitter, MAX2850*, Maxim Integrated Products, Inc., 33 pages, 2010.

Silicon Labs, *Layout Design Guide for the Si4455/435x RF ICs*, AN685, Silicon Laboratories, 22 pages, 2014.

International Searching Authority, International Search Report—International Application No. PCT/US2016/052215, dated May 29, 2017, together with the Written Opinion of the International Searching Authority, 17 pages.

* cited by examiner

Fig. 2 (Not to scale)

HYBRID LAMINATED PHASED ARRAY

PRIORITY

This patent application claims priority from provisional U.S. patent application No. 62/376,442, filed Aug. 18, 2016, entitled, "HYBRID LAMINATED PHASED ARRAY," and naming Vipul Jain, Nitin Jain and David Corman as inventors, the disclosure of which is incorporated herein, in its entirety, by reference.

FIELD OF THE INVENTION

The invention generally relates to phased array systems and, more particularly, the invention relates to laminar, low profile phased array systems.

BACKGROUND OF THE INVENTION

Antennas that emit electronically steered beams are known in the art as "phased array antennas." Such antennas are used worldwide in a wide variety of commercial and radar applications. They typically are produced from many small radiating elements that are individually phase controlled to form a beam in the far field of the antenna.

Among other things, phased array antennas are popular due to their ability to rapidly steer beams without requiring moving parts. One problem, however, is their cost—they can cost on the order of $1000 per element. Thus, for a 1000 element array, the cost can reach or exceed $1,000,000.

SUMMARY OF VARIOUS EMBODIMENTS

In accordance with one embodiment of the invention, a laminar phased array has a plurality of receive elements and dual transmit/receive elements supported on a substrate. The plurality of receive elements and dual transmit/receive elements form a patch array across the substrate. As such, the receive elements and dual transmit/receive elements form an array of patch antennas on the substrate. The phased array also has a plurality of integrated circuits supported on the substrate. At least a first set of the plurality of integrated circuits is configured to control reception of signals by the receive elements. In a corresponding manner, at least a second set of the plurality of integrated circuits is configured to control receipt and transmission of signals by the dual transmit/receive elements.

The plurality of integrated circuits may include a plurality of dual mode integrated circuits configured to control the dual transmit/receive elements, and a plurality of receive integrated circuits configured to control the receive elements. Each of the plurality of dual mode integrated circuits is considered to have a "dual mode IC area" adjacent to the substrate. In a similar manner, each of the plurality of receive integrated circuits also is considered to have a "receive IC area" adjacent to the substrate. The dual mode IC area preferably is larger than the receive IC area.

Each of the plurality of integrated circuits may control more than one receive element, or more than one dual transmit/receive element. Moreover, the plurality of integrated circuits may be configured to operate selected elements in a receive state, or in a transmit state. The dual transmit/receive elements may be in a transmit mode when in the transmit state, and in a receive mode when in the receive state.

Each one of the plurality of receive elements may be adjacent to at least one other of the receive elements to form a "receive element pitch." In a corresponding manner, each one of the plurality of dual transmit/receive elements may be adjacent to at least one other of the dual transmit/receive elements to form a "dual transmit/receive element pitch." The dual transmit/receive element pitch and receive element pitch preferably are different. For example, the dual transmit/receive element pitch may be smaller than the receive element pitch.

Moreover, while some of the respective elements may be adjacent to other like elements, the array may position least one of the plurality of integrated circuits within the respective element pitch. For example, an integrated circuit configured appropriately for a receive element may be connected to its two (or more) adjacent receive elements. As such, the presence of an intervening integrated circuit between two adjacent like elements (e.g., between two receive elements) does not change the relationship of those two elements as adjacent elements (e.g., the two receive elements with an integrated circuit between them still are considered to be adjacent receive elements). An intervening element, however, between two elements does cause the two elements separated by the intervening element to be not adjacent.

In accordance with another embodiment, a laminar phased array has a plurality of receive elements and a plurality of dual transmit/receive elements supported on a substrate. Each one of the plurality of receive elements is adjacent to at least one other of the receive elements to form a "receive element pitch." In a corresponding manner, each one of the plurality of dual transmit/receive elements is adjacent to at least one other of the dual transmit/receive elements to form a "dual transmit/receive element pitch." The receive element pitch and the dual transmit/receive element pitch preferably are different. Also, like other embodiments, the plurality of receive elements and dual transmit/receive elements form a patch array across the substrate. Accordingly, the receive elements and dual transmit/receive elements form patch antennas on the substrate. The phased array also has a plurality of integrated circuits supported on the substrate configured to control the receive elements and the dual transmit/receive elements.

In accordance with other embodiments of the invention, a method of forming a laminar phased array forms a plurality of receive elements and a plurality of dual transmit/receive elements on a substrate. The plurality of receive elements and dual transmit/receive elements form a patch array across the substrate. The method also positions a plurality of receive integrated circuits and a plurality of dual transmit/receive integrated circuits on the substrate. A set of the plurality of receive integrated circuits is between pairs of the receive elements, and a set of the plurality of dual transmit/receive integrated circuits is between pairs of the dual transmit/receive elements.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a single phased array has both receive elements, and dual receive/transmit elements on a single substrate. Using this arrangement, the single substrate can perform both transmit and receive functions with a smaller footprint than that required by prior art phased arrays. Moreover, the spacing or pitch between the elements preferably is optimized to both the receive and transmit functions. Details of various embodiments are discussed below.

Figure 1:
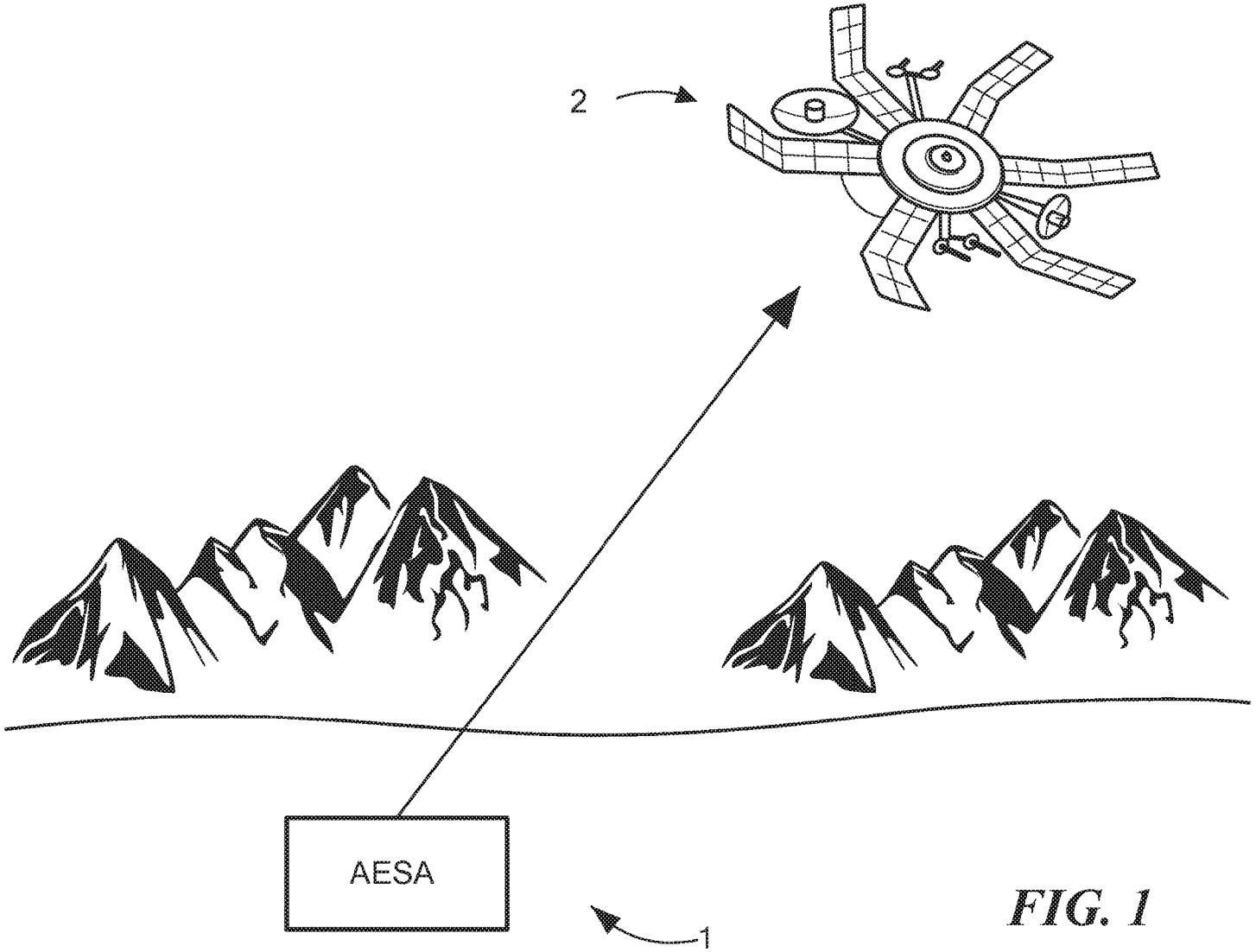
FIG. 1 schematically shows an active electronically steered antenna system ("AESA system") configured in accordance with illustrative embodiments of the invention and communicating with a satellite.

FIG. 1 schematically shows an active electronically steered antenna system ("AESA system 1") that may be configured in accordance with illustrative embodiments of the invention. In this example, the AESA system 1 communicates with an orbiting satellite 2. A phased array (discussed below and identified by reference number "10") implements the primary functionality of the AESA system 1. Specifically, as known by those skilled in the art, the phased array 10 forms one or more of a plurality of electronically steerable beams that can be used for a wide variety of applications. As a satellite communication system, for example, the AESA system 1 preferably is configured operate at one or more satellite frequencies. Among others, those frequencies may include the Ka-band, Ku-band, and/or X-band.

The satellite communication system may be part of a cellular network operating under a known cellular protocol, such as the 3G, 4G, or 5G protocols. Accordingly, in addition to communicating with satellites, the system may communicate (e.g., transmitting signals and receiving signals) with earth-bound devices, such as smartphones or other mobile devices, using any of the 3G, 4G, or 5G protocols. As another example, the satellite communication system may transmit/receive information between aircraft and air traffic control systems. Of course, those skilled in the art may use the AESA system 1 (implementing the below discussed phased array 10) in a wide variety of other applications, such as broadcasting, optics, radar, etc. Some embodiments may be configured for non-satellite communications and instead communicate with other devices, such as smartphones (e.g., using 4G or 5G protocols). Accordingly, discussion of communication with orbiting satellites 2 is not intended to limit all embodiments of the invention.

Figure 2:
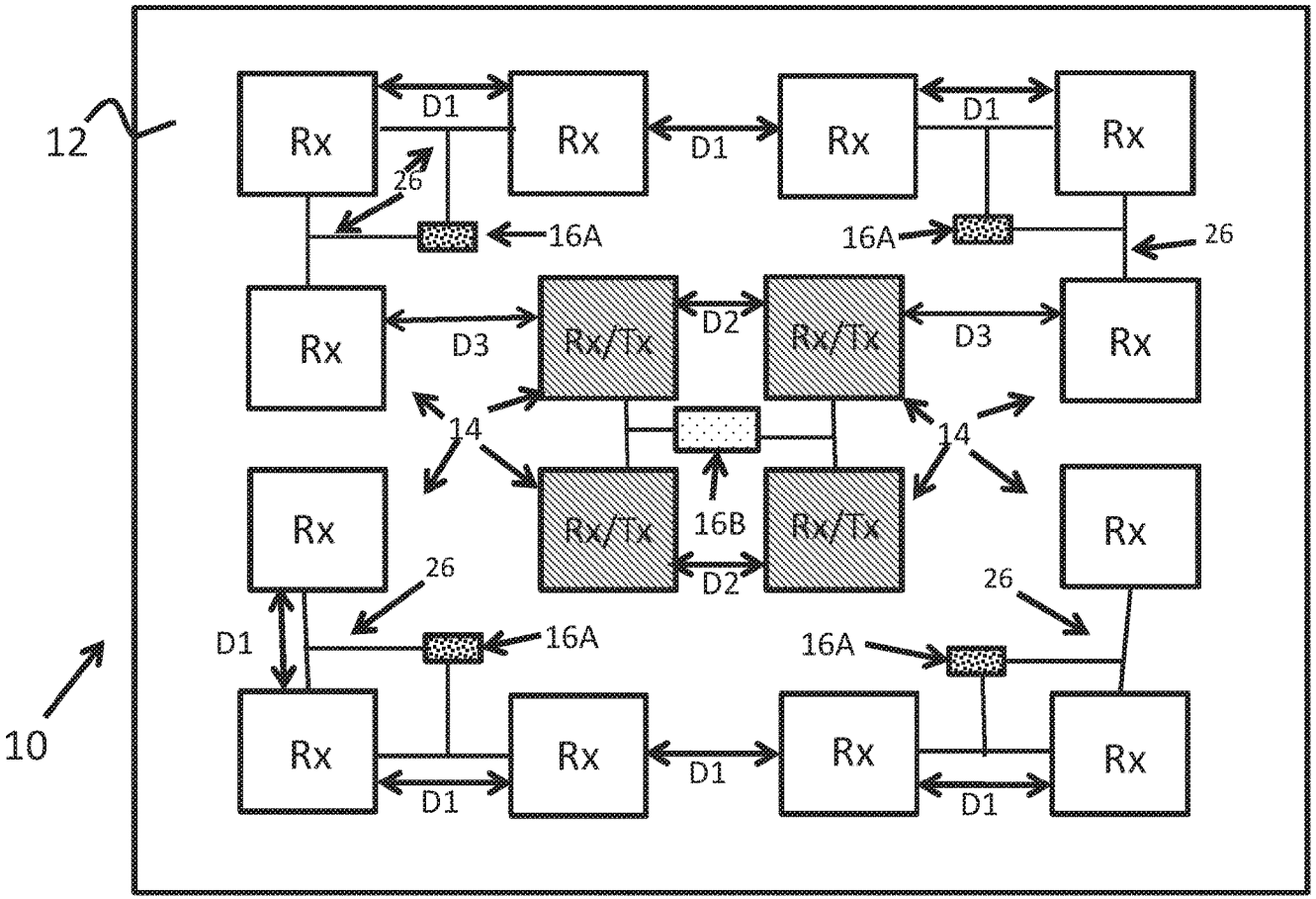
FIG. 2 schematically shows a plan view of a patch array configured in accordance with illustrative embodiments of the invention.
Figure 3:
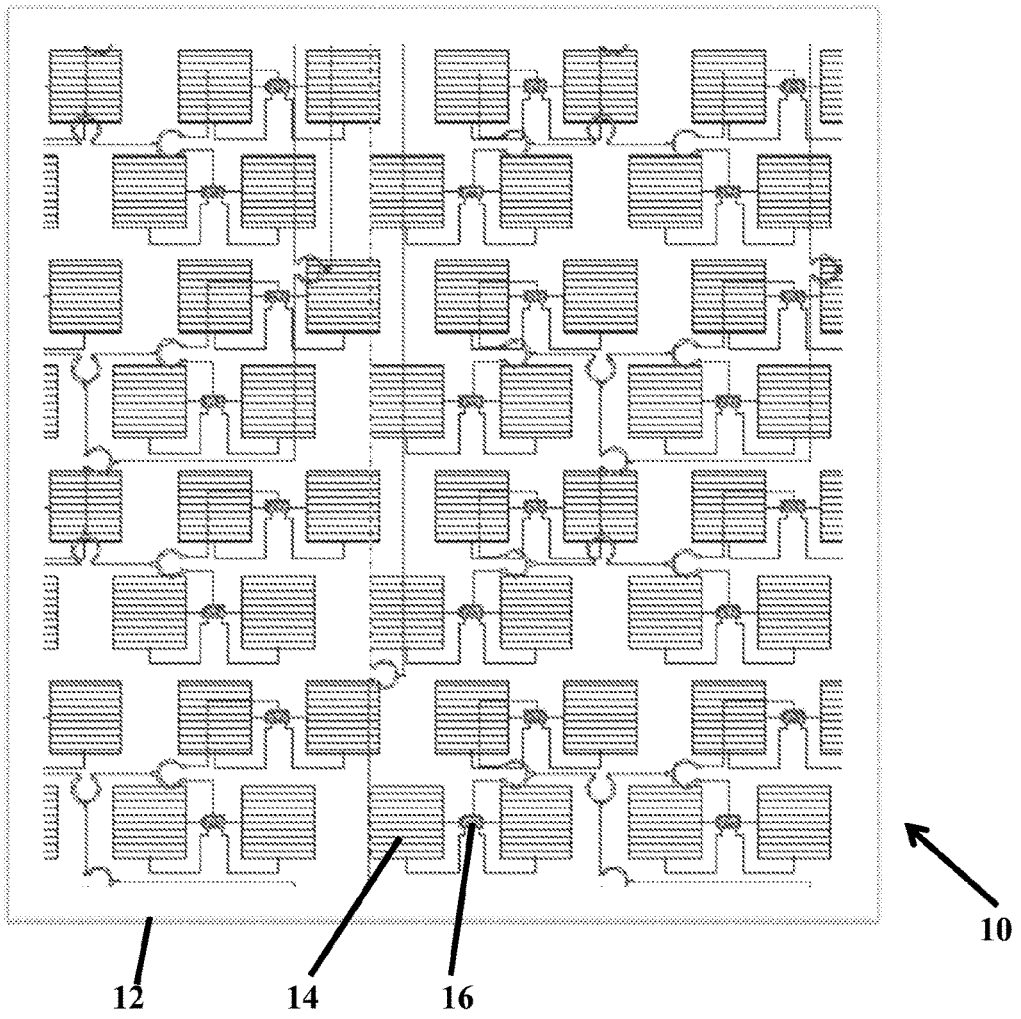
FIG. 3 schematically shows a plan view of a triangular patch array configured in accordance with illustrative embodiments of the invention.

FIG. 2 schematically shows a laminar/laminate phased array 10 configured in accordance with illustrative embodiments of the invention. FIG. 3 schematically shows another array 10 that may be configured in a similar manner. Each of these phased arrays 10 may be part of the AESA system 1 described above.

One primary difference between the array 10 of FIG. 2 and the array 10 of FIG. 3 is the configuration of the elements 14; the array 10 of FIG. 2 is configured in a generally rectangular configuration, while the array 10 in FIG. 3 is configured in a generally triangular configuration. When compared to the rectangular lattice configuration, the triangular lattice configuration of FIG. 3 requires fewer elements 14 (e.g., about 15 percent fewer in some implementations) for a given grating lobe free scan volume. Those skilled in the art can apply principles of illustrative embodiments to these and other configurations of the array 10. Accordingly, discussion of rectangular and triangular phased arrays is illustrative only and not intended to limit all embodiments.

As shown, the array 10 of FIG. 2 has a printed circuit board 12 (i.e., a base or substrate) supporting a plurality of elements 14 (e.g., antennas). Specifically, the plurality of elements 14 preferably are formed as a plurality of patch antennas oriented in the configuration of a rectangular patch array 10. In this case, the elements 14 are laid out in a 4×4 array. Indeed, this is a very small phased array. Those skilled in the art can apply principles of illustrative embodiments described in terms of these small phased arrays to laminar phased arrays with dozens, hundreds, or even thousands of elements 14. For example, the array of FIG. 2 can have additional rows and columns of elements 14 on each side of the array as shown.

In accordance with illustrative embodiments of the invention, and as shown in FIG. 2, the array 10 has two different types of elements 14—receive elements 14 (identified in FIG. 2 as "Rx") and dual mode receive and transmit elements 14 (identified in FIG. 2 as "Rx/Tx" and referred to as "dual-mode elements 14" or "dual transmit/receive elements 14"). The receive elements 14 are configured to receive incoming signals only. In contrast, the dual-mode elements 14 are configured to either transmit signals or receive signals, depending on the mode of the array 10 at the time of the operation. Specifically, the array 10 can be in either a transmit mode, or a receive mode. Accordingly, when in the transmit mode, only the dual-mode elements 14 operate. In contrast, when in the receive mode, some or all of the elements 14 operate. A controller 24, discussed below with regard to FIG. 4, controls the mode of the array 10.

The array 10 has a plurality of integrated circuits 16 for controlling operation of the plurality of receive elements 14 and dual-mode elements 14. Those skilled in the art often refer to these integrated circuits 16 controlling beam transmission as "beam steering integrated circuits." In illustrative embodiments, each integrated circuit 16 is configured with at least the minimum number of functions to accomplish the desired effect. Indeed, integrated circuits for the receive elements 14 (identified in FIG. 2 by reference number "16A") will have some different functionality than that of the integrated circuits for the dual-mode elements 14 (identified in FIG. 2 by reference number "16B"). Accordingly, integrated circuits 16A for receive elements 14 typically have a smaller footprint than the integrated circuits 16B that control the dual-mode elements 14.

As an example, depending on its role in the array 10, each integrated circuit 16 may include some or all of the following functions:

- phase shifting,
- amplitude controlling/beam weighting,
- switching between transmit mode and receive mode,
- output amplification to amplify output signals to the elements 14,
- input amplification for received RF signals (e.g., signals received from a satellite), and
- power combining and splitting between elements 14.

Indeed, some embodiments of the integrated circuits 16 may have additional or different functionality, although illustrative embodiments are expected to operate satisfactorily with the above noted functions. Those skilled in the art can configure the integrated circuits 16 in any of a wide variety of manners to perform those functions. For example, the input amplification may be performed by a low noise amplifier, the phase shifting may use conventional phase shifters, and the switching functionality may be implemented using conventional transistor-based switches.

As known in the industry, the cost of the array 10 is directly related to the total number of elements 14 and integrated circuits 16 supported by the printed circuit board 12. Moreover, the number of integrated circuits 16 also has a direct relation to the size of the printed circuit board 12. In fact, the total number of integrated circuits 16 used and the size of the printed circuit board 12 accounts for a substantial majority of the total array costs.

Each integrated circuit 16 preferably operates on at least one element 14 in the array. In preferred embodiments, however, like elements 14 share integrated circuits 16. For example, in FIG. 2, the integrated circuits 16A that control the receive elements 14 operate on three receive elements 14. In a corresponding manner, the integrated circuits 16B that control the dual-mode elements 14 operate on four dual-mode elements 14. Other embodiments may enable the integrated circuits 16A and 16B to control more or fewer elements 14. For example, one integrated circuit 16A may control four receive elements 14.

Indeed, those skilled in the art can adjust the number of elements 14 sharing an integrated circuit 16 based upon the application. Sharing the integrated circuits 16 between multiple elements 14 in this manner thus reduces the required total number of integrated circuits 16, correspondingly reducing the required size of the printed circuit board 12. Together, these factors should contribute to cost reductions in the array 10.

From the perspective of FIG. 2, each receive integrated circuit 16A has an element 14 generally to its left side, an element 14 generally to its right side, and elements 14 above and below it. In other words, as shown in FIG. 2, the integrated circuits 16A are positioned in an interstitial space on the top surface of the printed circuit board 12 between the receive elements 14 and/or the dual mode elements 14. In a similar manner, the integrated circuit 16B also is positioned in an interstitial space on the top surface of the board 12 between the dual-mode elements 14. Alternatively, the integrated circuits 16A and 16B can be positioned on the opposite side of the printed circuit board 12; i.e., the side opposite to the surface with the elements 14.

As shown in FIGS. 2 and 3, RF interconnect and beam forming lines 26 electrically connect the integrated circuits 16A and 16B to their respective elements 14. To minimize the feed loss, illustrative embodiments mount the integrated circuits 16 as close to their respective elements 14 as possible. To that end, each integrated circuit 16 preferably is packaged either with a flipped configuration using wafer level chip scale packaging (WLCSP), or a traditional package, such as quad flat no-leads package (QFN package). This should minimize noise figure by ensuring that each RF interconnect line is correspondingly short. Preferred embodiments use low noise figure silicon processes, as benchmarked by a minimum achievable noise figure, NFmin, for optimal low noise amplifier noise figures.

Those skilled in the art can select the appropriate numbers of receive elements 14, and the appropriate number of dual-mode elements 14 based upon the application. Specifically, a given application may have a specified minimum equivalent isotropically radiated power ("EIRP") for transmitting signals. In addition, that same application may have a specified minimum G/T (analogous to a signal-to-noise ratio) for receiving signals, where:

G denotes the gain or directivity of the antenna, and

T denotes the noise temperature of the receiving element 14 and is related to noise factor "F" by $T=To(F-1)$.

Accordingly, those skilled in the art may require that the array 10 have at least a minimum number of dual-mode elements 14 to meet the minimum EIRP. Of course, the array 10 may have more dual-mode elements 14 beyond that minimum number. In a similar manner, those skilled in the art may require that the array 10 have at least a minimum number of receive elements 14 to meet the minimum G/T. Again, like the dual-mode elements 14, the array 10 also may have more receive elements 14 beyond that minimum number.

Other embodiments may use other requirements for selecting the appropriate number of elements 14. Accordingly, discussion of the specific means for selecting the appropriate number of elements 14 is for descriptive purposes only and not intended to limit various embodiments of the invention.

Some embodiments space the dual-mode elements 14 and receive elements 14 a generally uniform distance apart, regardless of their respective functions. The inventors discovered, however, that varying the spacing based upon 1) the type of element 14 and 2) the type of element 14 next to it can provide substantial performance improvements. Specifically, receive elements 14 generally operate better when they are spaced farther apart, while transmit elements 14 generally operate better when they are spaced closer together. This presents a substantial problem in a hybrid array, such as the array 10 of FIGS. 2 and 3, in which the printed circuit board 12 supports both dual-mode elements 14 and receive elements 14.

To overcome this problem, illustrative embodiments space receive elements 14 a first distance from any other element 14 (regardless of the type of element), and dual-mode elements 14 a second distance from any other dual-mode element 14. This distance also may be referred to as a "pitch" between elements 14. In FIG. 2, this first distance/pitch is shown by example at several locations of the array 10, identified as distance "D1." In a corresponding manner, FIG. 2 shows the second distance/pitch by example at two locations of the array 10, identified as distance "D2." The first distance D1 preferably is larger than the second distance D2 due to the nature of receive and transmit elements 14.

Specifically, in illustrative embodiments, the first distance D1 is based upon the wavelength of the signals expected to be received by the array 10. For example, the first distance D1 may be equal to between about 40 to 60 percent of the wavelength of the incoming signal. Such received signals are specified by the application. In a similar manner, the second distance D2 also is based upon the wavelength of the signals expected to be transmitted by the array 10. For example, the first distance D2 may be equal to between about 40 to 60 percent of the wavelength of the outgoing/transmitted signal. In a manner similar to the received signals, the transmitted signals are specified by the application. Indeed, the distances D1 and D2 can be set to values outside of the 40-60 percent of relevant wavelength and still meet various goals of illustrative embodiments. FIG. 2 also shows another distance, D3, which is the distance between a receive element 14 and a dual-mode element 14. D3 preferably is greater than each of D2 and D1. In some embodiments, D3 is about equal to D1.

Accordingly, during use, a controller 24 (FIG. 4, discussed below) controls the mode of the array 10—either a receive mode or a transmit mode. When in the receive mode, all 16 elements 14 of FIG. 2 are configured to receive incoming signals. Among other places, those incoming signals may be received from a satellite or other device. When in the transmit mode, however, the four dual-mode elements 14 of FIG. 2 are correspondingly in the transmit mode—the receive elements 14 may not be in use. Accordingly, only those four elements 14 transmit a signal to a remote device, such as a satellite or other device. The 12 receive elements 14 thus may remain idle at this time.

Some embodiments may arrange the elements 14 of FIG. 2 in another configuration. For example, the dual-mode elements 14 may not necessarily be clustered adjacent to each other. Those skilled in the art can select the appropriate positioning and orientations based upon the application and other factors.

As an array 10 of patch antennas, the elements 14 have a low profile. Specifically, as known by those skilled in the art, a patch antenna can be mounted on a flat surface and includes a flat rectangular sheet of metal (known as the "patch") mounted over a larger sheet of metal known as a "ground plane." A dielectric layer between the two metal plates electrically isolates the two plates to eliminate direct conduction. When energized, the patch and ground plane together produce a radiating electric field. Illustrative embodiments may form the patch antennas using conventional semiconductor fabrication processes, such as by depositing successive metal layers that form the noted metal plates. Accordingly, using these fabrication processes, each element 14 in the array 10 should have a very low profile.

Figure 4:
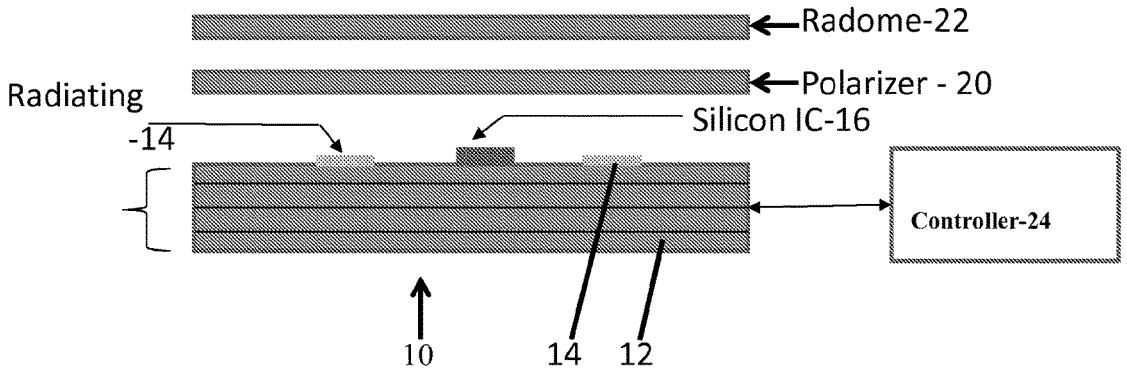
FIG. 4 schematically shows a cross-sectional view of a portion of the patch array of FIG. 2.

To that end, FIG. 4 schematically shows a cross-sectional view of a small portion of the array 10 of FIG. 2. This view shows one single silicon integrated circuit 16 mounted onto the printed circuit board 12 between two elements 14; i.e., on the same side of the printed circuit board 12 juxtaposed with the two elements 14. Alternatively, the integrated circuit 16 could be on the other side of the printed circuit board 12. In addition, the array 10 also has a polarizer 20 to selectively filter signals to and from the array 10, and a radome 22 to environmentally protect the array 10. A separate antenna controller 24 (noted above) may electrically connect with the array 10 to calculate beam steering vectors and switch between the receive mode and the transmit mode.

Figure 5:
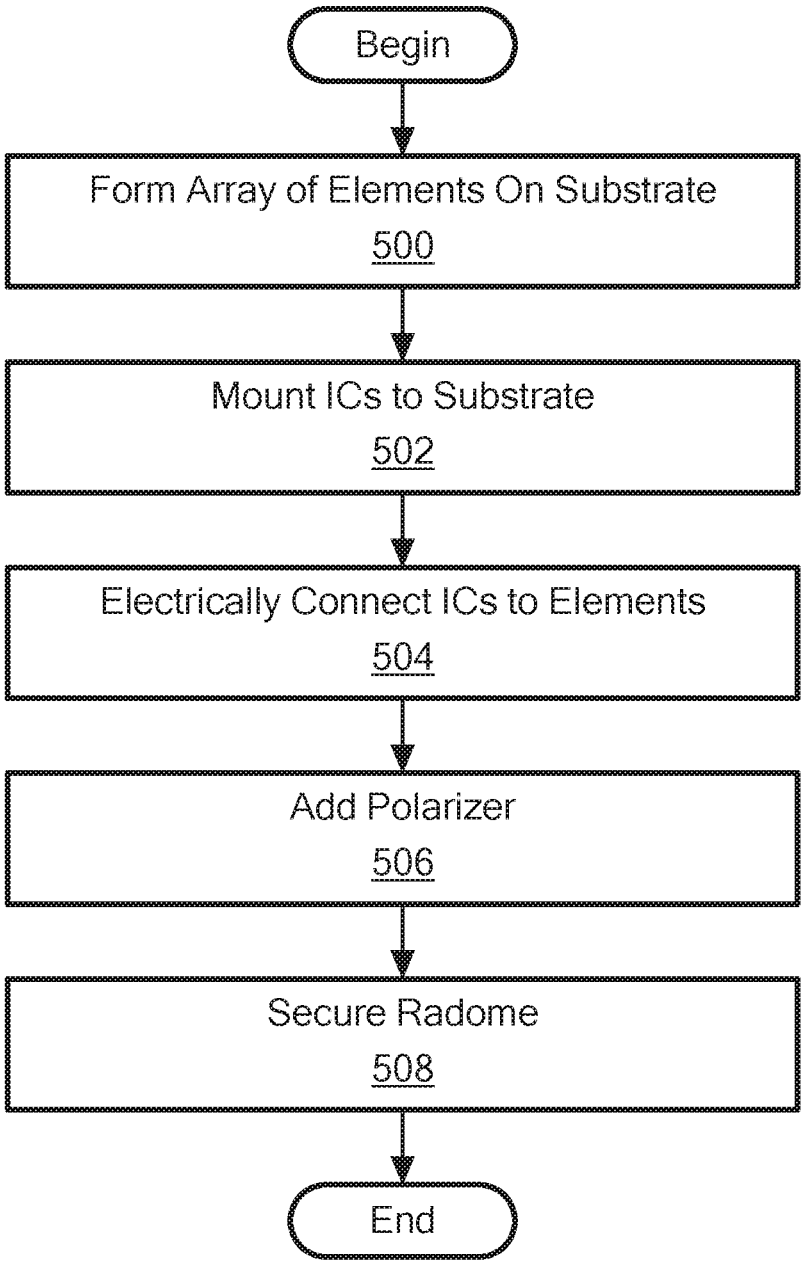
FIG. 5 shows a process of forming the patch arrays of FIGS. 2 and 3 in accordance with illustrative embodiments of the invention.

FIG. 5 shows a process of forming the phased array 10 and AESA system 1 in accordance with illustrative embodiments of the invention. It should be noted that this process is substantially simplified from a longer process that normally would be used to form the AESA system 1. Accordingly, the process of forming the AESA system 1 is expected to have many steps, such as testing steps, soldering steps, or passivation steps, which those skilled in the art may use.

In addition, some of the steps may be performed in a different order than that shown, or at the same time. Those skilled in the art therefore can modify the process as appropriate. Moreover, as noted above and below, the discussed materials and structures are merely examples. Those skilled in the art can select the appropriate materials and structures depending upon the application and other constraints. Accordingly, discussion of specific materials and structures is not intended to limit all embodiments.

The process of FIG. 5 begins at step 500, which forms the array of elements 14 on the substrate/printed circuit board 12. As noted above, a set of the elements 14 preferably are receive elements while another set of elements 14 are configured to be dual transmit/receive elements. The elements 14 preferably are formed from metal deposited onto the substrate 12 in a specific lattice configuration, such as a triangular or rectangular lattice. This step also may form pads (not shown) and transmission lines 26 on the printed circuit board 12 to extend to the elements 14 (from the pads). As discussed below, these lines 26 electrically connect the integrated circuits 16A and 16B with the elements 14. It should be noted that in FIG. 2, like the elements 14, not all of the transmission lines 26 are identified by their reference number. Instead, to simplify the drawings, only a few representative transmission lines 26 were identified by their reference number. FIG. 2 therefore shows other transmission lines 26 that are not labelled with their reference number.

In preferred embodiments and as discussed above, the elements 14 are spaced apart from each other as a function of the wavelength of the signals expected to be transmitted and received by the AESA system 1. For example, the distances between the elements 14 may be spaced apart a distance equal to between 40-60 percent of the wavelength of the relevant signals. Preferred embodiments vary the spacing of the elements 14, as noted above.

Those skilled in the art can select the appropriate numbers of elements 14, based upon the application. Specifically, a given application may require a specified minimum equivalent isotropically radiated power ("EIRP") for transmitting signals. In addition, that same application may have a specified minimum G/T for receiving signals. Thus, step 500 may form the array to have a minimum number of elements 14 to meet either or both the EIRP and the G/T requirements of the application. For example, after establishing a feed loss and noise figure of a receive amplifier, one skilled in the art can set the array size to a desired G/T. Of course, the phased array 10 may have more elements 14 beyond that minimum number.

Other embodiments may use other requirements for selecting the appropriate number of elements 14. Accordingly, discussion of the specific means for selecting the appropriate number of elements 14, and their spacing, is for descriptive purposes only and not intended to limit various embodiments of the invention.

At step 502, the process mounts the integrated circuits 16A and 16B to the printed circuit board 12/substrate 12. For example, each integrated circuit 16A for the receive elements 14 may be positioned adjacent to a receive element 14, or between a pair of receive elements 14. In a similar manner, each integrated circuit 16B for the dual transmit/receive elements 14 may be positioned adjacent to a dual transmit/receive element 14, or between a pair of dual transmit/receive elements 14. To those ends, as noted above, when using WLCSP integrated circuits 16, illustrative embodiments may use conventional flip-chip mounting processes. Such a process directly electrically connects the integrated circuits 16A and 16B to the elements 14 (step 504). To that end, such embodiments may deposit solder paste (e.g., powdered solder and flux) on pads of the printed circuit board 12, and position the integrated circuits 16A and 16B on their respective board pads. Then, the printed circuit board 12 may be heated (e.g., using a reflow oven or process) to physically and electrically couple the pads with the solder.

Some embodiments that do not use flip-chip mounted WLCSP integrated circuits 16, however, may require the additional step of step 504 to electrically connect the integrated circuits 16A and 16B to the elements 14. For example, a wirebond operation may be required to solder wirebonds between the integrated circuits 16A and 16B and the elements 14.

The process concludes by adding the polarizer 20 (step 506) and securing the radome 22 (step 508) to the apparatus in a conventional manner.

Illustrative embodiments thus selectively partition two different types of elements 14 on a single phased array to produce results that, previously, either required larger arrays, or multiple arrays. In other words, the arrays of FIGS. 1-4 are examples of hybrid phased arrays in the sense that they have two different types of elements 14—dual mode elements 14 and receive elements 14 in this case. Accordingly, using these and related techniques, those skilled in the art may develop a satisfactorily functioning laminar phased array for a fraction of the cost of prior art laminar phased arrays.

Although the above discussion discloses various exemplary embodiments of the invention, it should be apparent that those skilled in the art can make various modifications that will achieve some of the advantages of the invention without departing from the true scope of the invention.

What is claimed is:

1. A laminar phased array comprising:

a substrate;

a plurality of receive elements supported on the substrate;

a plurality of dual transmit/receive elements supported on the substrate, the plurality of receive elements and dual transmit/receive elements forming a patch array across the substrate, the receive elements and dual transmit/receive elements forming patch antennas on the substrate; and a plurality of integrated circuits supported on the substrate, at least a first set of the plurality of integrated circuits configured to control receipt of signals by the receive elements, at least a second set of the plurality of integrated circuits configured to control receipt and transmission of signals by the dual transmit/receive elements, wherein the plurality of integrated circuits includes a plurality of dual mode integrated circuits configured to control the dual transmit/receive elements, wherein the plurality of integrated circuits includes a plurality of receive integrated circuits configured to control the receive elements, wherein each of the plurality of dual mode integrated circuits has a dual mode IC area adjacent to the substrate, further wherein each of the plurality of receive integrated circuits has a receive IC area adjacent to the substrate, the dual mode IC area being larger than the receive IC area.

2. The phased array as defined by claim 1 wherein each of the plurality of integrated circuits controls more than one receive element, or more than one dual transmit/receive element.

3. The phased array as defined by claim 1 wherein the plurality of integrated circuits are configured to control selected elements in a receive state or in a transmit state, the dual transmit/receive elements being in a transmit mode when in the transmit state, the dual transmit/receive elements being in a receive mode when in the receive state.

4. The phased array as defined by claim 1 wherein each one of the plurality of receive elements is adjacent to at least one other of the receive elements to form a receive element pitch.

5. The phased array as defined by claim 4 wherein each one of the plurality of the dual transmit/receive elements is adjacent to at least one other of the dual transmit/receive elements to form a dual transmit/receive element pitch.

6. The phased array as defined by claim 5 wherein the dual transmit/receive element pitch and receive element pitch are different.

7. The phased array as defined by claim 6 wherein the dual transmit/receive element pitch is smaller than the receive element pitch.

8. The phased array as defined by claim 4 wherein at least one of the plurality of integrated circuits is positioned within the receive element pitch and electrically connected to at least two adjacent receive elements.

9. The phased array as defined by claim 4 wherein at least one of the plurality of receive elements is adjacent to at least one of the dual transmit/receive elements to form a third pitch that is about equal to the receive element pitch.

10. A method of forming a laminar phased array comprising:

forming a plurality of receive elements on a substrate;

forming a plurality of dual transmit/receive elements on the substrate, the plurality of receive and dual transmit/receive elements forming a patch array across the substrate;

positioning a plurality of receive integrated circuits on the substrate, a set of the plurality of receive integrated circuits being between pairs of the receive elements; and positioning a plurality of dual transmit/receive integrated circuits on the substrate, a set of the plurality of dual transmit/receive integrated circuits being between pairs of the dual transmit/receive elements.

11. The method as defined by claim 10 wherein forming the receive elements comprises forming a plurality of substantially planar metal sheets on the substrate.

12. The method as defined by claim 10 wherein each one of the plurality of receive elements is formed adjacent to at least one other of the receive elements to form a receive element pitch, further wherein each one of the plurality of dual transmit/receive elements is formed adjacent to at least one other of the dual transmit/receive elements to form a dual transmit/receive element pitch, the receive element pitch being different from the dual transmit/receive element pitch.

13. The method as defined by claim 12 wherein the receive element pitch is larger than the dual transmit/receive element pitch.

14. The method as defined by claim 10 further comprising electrically connecting each integrated circuit of a set of the integrated circuits to a plurality of the elements.

15. The product formed by the method of claim 10.

16. A laminar phased array comprising:

a substrate;

a plurality of receive elements supported on the substrate;

a plurality of dual transmit/receive elements supported on the substrate, the plurality of receive elements and dual transmit/receive elements forming a patch array across the substrate, the receive elements and dual transmit/receive elements forming patch antennas on the substrate; and a plurality of integrated circuits supported on the substrate, at least a first set of the plurality of integrated circuits configured to control receipt of signals by the receive elements, at least a second set of the plurality of integrated circuits configured to control receipt and transmission of signals by the dual transmit/receive elements, wherein each one of the plurality of receive elements is adjacent to at least one other of the receive elements to form a receive element pitch, wherein at least one of the plurality of integrated circuits is positioned within the receive element pitch and electrically connected to at least two adjacent receive elements.

17. The phased array as defined by claim 16 wherein at least one of the plurality of receive elements is adjacent to at least one of the dual transmit/receive elements to form a third pitch that is about equal to the receive element pitch.

18. The phased array as defined by claim 16 wherein each of the plurality of integrated circuits controls more than one receive element, or more than one dual transmit/receive element.

19. The phased array as defined by claim 16 wherein the plurality of integrated circuits are configured to control selected elements in a receive state or in a transmit state, the dual transmit/receive elements being in a transmit mode when in the transmit state, the dual transmit/receive elements being in a receive mode when in the receive state.

20. The phased array as defined by claim 16 wherein each one of the plurality of receive elements is adjacent to at least one other of the receive elements to form a receive element pitch, each one of the plurality of the dual transmit/receive elements being adjacent to at least one other of the dual transmit/receive elements to form a dual transmit/receive element pitch, the dual transmit/receive element pitch and receive element pitch are different.

21. The phased array as defined by claim 20 wherein the dual transmit/receive element pitch is smaller than the receive element pitch.

22. A laminar phased array comprising:

a substrate;

a plurality of receive elements supported on the substrate;

a plurality of dual transmit/receive elements supported on the substrate, the plurality of receive elements and dual transmit/receive elements forming a patch array across the substrate, the receive elements and dual transmit/receive elements forming patch antennas on the substrate; and a plurality of integrated circuits supported on the substrate, at least a first set of the plurality of integrated circuits configured to control receipt of signals by the receive elements, at least a second set of the plurality of integrated circuits configured to control receipt and transmission of signals by the dual transmit/receive elements, wherein each one of the plurality of receive elements is adjacent to at least one other of the receive elements to form a receive element pitch, further wherein at least one of the plurality of receive elements is adjacent to at least one of the dual transmit/receive elements to form a third pitch that is about equal to the receive element pitch.

23. The phased array as defined by claim 22 wherein each of the plurality of integrated circuits controls more than one receive element, or more than one dual transmit/receive element.

24. The phased array as defined by claim 22 wherein each one of the plurality of receive elements is adjacent to at least one other of the receive elements to form a receive element pitch, each one of the plurality of the dual transmit/receive elements being adjacent to at least one other of the dual transmit/receive elements to form a dual transmit/receive element pitch, the dual transmit/receive element pitch and receive element pitch are different.

* * * * *